US008776468B2

(12) United States Patent
Henriquez

(10) Patent No.: US 8,776,468 B2
(45) Date of Patent: Jul. 15, 2014

(54) INSULATION ROOF OR FLOOR PANELS WITH DEFORMATION RESISTANT ELEMENTS FOR COMPOSITE INSULATED CONCRETE ROOF OR FLOOR SYSTEM AND SUCH SYSTEM

(76) Inventor: Jose L. Henriquez, Miami, FL (US)

( * ) Notice: Subject to any disclaimer, the term of this patent is extended or adjusted under 35 U.S.C. 154(b) by 352 days.

(21) Appl. No.: 12/839,377

(22) Filed: Jul. 19, 2010

(65) Prior Publication Data

US 2011/0036046 A1 Feb. 17, 2011

Related U.S. Application Data

(63) Continuation-in-part of application No. 29/342,372, filed on Aug. 24, 2009, now Pat. No. Des. 620,144, and a continuation-in-part of application No. 29/342,374, filed on Aug. 24, 2009, now Pat. No. Des. 620,145, and a continuation-in-part of application No. 29/342,377, filed on Aug. 24, 2009, now Pat. No. Des. 620,146, and a continuation-in-part of application No. 29/342,382, filed on Aug. 24, 2009, now Pat. No. Des. 620,147, and a continuation-in-part of application No. 12/542,150, filed on Aug. 17, 2009, now Pat. No. 8,276,332.

(51) Int. Cl.
*E04C 2/34* (2006.01)

(52) U.S. Cl.
USPC ..... 52/481.1

(58) Field of Classification Search
USPC ..... 52/220.2, 407.1, 407.5, 407.3, 506.03, 52/793.1, 794.1, 481.1, 764, 766, 781.3, 52/745.13, 481.2, 482, 489.2
See application file for complete search history.

(56) References Cited

U.S. PATENT DOCUMENTS

| | | | | |
|---|---|---|---|---|
| 4,185,437 | A * | 1/1980 | Robinson | 52/601 |
| 4,435,936 | A * | 3/1984 | Rutkowski | 52/481.1 |
| 4,674,723 | A * | 6/1987 | Bayuk | 248/246 |
| 5,414,972 | A * | 5/1995 | Ruiz et al. | 52/600 |
| 5,758,463 | A * | 6/1998 | Mancini, Jr. | 52/309.12 |
| 6,151,858 | A * | 11/2000 | Ruiz et al. | 52/481.1 |
| 6,871,462 | B2 | 3/2005 | Azizinamini | |
| 7,823,350 | B2 * | 11/2010 | Valle et al. | 52/356 |
| 8,176,696 | B2 * | 5/2012 | LeBlang | 52/309.12 |
| 2005/0055967 | A1 * | 3/2005 | Kariakin | 52/720.1 |
| 2007/0245657 | A1 * | 10/2007 | Valle et al. | 52/356 |
| 2009/0205285 | A1 | 8/2009 | Jendusa | |
| 2010/0058686 | A1 | 3/2010 | Henriquez | |

FOREIGN PATENT DOCUMENTS

| | | |
|---|---|---|
| JP | 2002004473 | 1/2002 |

* cited by examiner

*Primary Examiner* — Chi Q Nguyen
(74) *Attorney, Agent, or Firm* — CUSPA Technology Law Associates; Yi Li

(57) ABSTRACT

An insulation roof or floor panel for construction of a composite insulated concrete roof or floor includes two elongated studs, each having a web section and upper and lower flanges, a plurality of deformation resistant elements protruding from the upper flange of the studs and spaced apart along the upper flange of each stud, and an insulation board secured between the two elongated studs. The insulation board has a thickness less than the width of the web section of the studs, with the lower surface of the insulation board against the upper flanges of the studs, thereby establishing a distance between the upper surface of the insulation board and the upper flanges of the studs. Further provided are a composite insulated concrete roof or floor system with enhanced resistance to deformation, constructed using the insulation roof or floor panel, and the method of construction.

19 Claims, 16 Drawing Sheets

INSULATION ROOF OR FLOOR PANELS WITH DEFORMATION RESISTANT ELEMENTS FOR COMPOSITE INSULATED CONCRETE ROOF OR FLOOR SYSTEM AND SUCH SYSTEM

CROSS REFERENCE TO RELATED APPLICATION

This application is a continuation-in-part of patent application Ser. No. 29/342,372, filed Aug. 24, 2009, now U.S. Pat.No. D620,144, a continuation-in-part of patent application Ser. No. 29/342,374, filed Aug. 24, 2009, now U.S. Pat. No. D620,145, a continuation-in-part of patent application Ser. No. 29/342,377, filed Aug. 24, 2009, now U.S. Pat. No. D620,146, a continuation-in-part of patent application Ser. No. 29/342,382, filed Aug. 24, 2009, now U.S. Pat. No. D620, 147, and a continuation-in-part of patent application Ser. No. 12/542,150, filed Aug. 17, 2009, now U.S. Pat. No. 8,276, 332. All parent applications are hereby incorporated by reference in their entirety.

FIELD OF THE INVENTION

The present invention relates to insulation roof or floor panels, particularly relates to insulation roof or floor panels having built-in deformation resistant elements for construction of a composite insulated concrete roof or floor system with increased resistance to deformation, and such a composite insulated concrete roof or floor system, and method of construction.

BACKGROUND OF THE INVENTION

Composite concrete roof system or floor systems of multistory buildings are known. Conventional composite concrete roof or floor systems are formed of reinforced concrete slabs, which integrate concrete with reinforcing bars and support beams. It is known that as concrete cures, composite concrete roof or floor systems have a certain degree of deformation, particularly deflection in the vertical direction, due to the loads, including both dead load (the weight of the system itself) and live load (equipments, furniture and people). Therefore, there are strict requirements on the span of reinforced concrete slabs, which limit the maximum span between supporting structures. Typically, when the amount of reinforced bars and the thickness of the concrete are increased, it increases the resistance of a system to deflection. However, as the amount of reinforced bars and the thickness of the concrete increase, the dead load of the system increases, which adds to the cause of deflection.

Therefore, there is a need for improved construction materials and process for producing composite concrete roof or floor systems with enhanced resistance to structural deformation, particularly deflection in the vertical direction. It is also cost effective to use prefabricated roof or floor panels for construction of such improved composite concrete roof or floor systems. Moreover, there is further a need for light weight roof or floor systems with insulation property.

SUMMARY OF THE INVENTION

In one aspect, the present invention is directed to an insulation roof or floor panel for construction of a composite insulated concrete roof or floor. The insulation roof or floor panel comprises two elongated studs, each comprising a planar web section and an upper flange and an lower flange integrally extending from the web section, the two elongated studs aligned in parallel in a longitudinal direction of the studs, with the flanges facing each other; a plurality of deformation resistant elements protruding from the upper flange of each of the studs, the deformation resistant elements spaced apart along the upper flange of each of the studs in the longitudinal direction; and an insulation board secured between the two elongated studs, the insulation board having upper and lower surfaces and having a thickness less than a width of the web section of the stud, the lower surface of the insulation board being disposed against the lower flanges of the studs, thereby establishing a distance between the upper surface of the insulation board and the upper flanges of the studs. In one embodiment, the deformation resistant elements are in a form of brackets or pins.

In a further embodiment, the present invention is directed to a composite insulated concrete roof or floor system. The system comprises a roof or floor panel assembly comprising a plurality of insulation roof or floor panels of the present invention aligned one next to another, with the web sections of two adjacent elongated studs against each other, with the deformation resistant elements oriented in upward direction; a plurality of reinforcing bars placed above the roof or floor panel assembly; and a sufficient amount of concrete covering the plurality of deformation resistant elements protruding from the upper flange of each of the studs and the plurality of reinforcing bars, the concrete having an integral internal portion thereof filled into a space between the upper surface of the insulation board and the upper flanges of the studs of each of the roof or floor panels, and a continuous external portion throughout the assembly.

In another embodiment, the present invention is directed to a monolithic composite insulated concrete wall and roof or floor system. The system comprises (a) a wall assembly comprising a plurality of insulation wall panels, each thereof comprising two elongated wall panel studs aligned, each comprising a planar web section, and an inner flange and an outer flange integrally extending from the web section; and a wall panel insulation board secured between the two wall panel studs, the wall panel insulation board having inner and outer surfaces and a thickness less than a width of the web section of the wall panel stud; the inner surface of the insulation board disposed against the inner flanges of the wall panel studs, thereby establishing a distance between the outer surface of the wall panel insulation board and the outer flanges of the wall panel studs; the wall panel insulation board recessing from upper ends of the wall panel studs; the plurality of insulation wall panels being aligned one next to another, having the inner surface of the wall panel insulation board facing an interior of a building structure and having the web sections of the elongated wall panel studs against each other; (b) a roof or floor panel assembly comprising a plurality of insulation roof or floor panels of the present invention aligned one next to another, with the deformation resistant elements oriented in upward direction, and with both ends of each of the roof or floor panels disposed on top of and fastened to the wall panel assembly; (c) concrete covering throughout the roof or floor panel assembly, the concrete filled into a space between the upper surface of the roof or floor panel insulation board and the upper flanges of the roof or floor panel studs of each of the roof or floor panels, into a space between the outer surface of the wall panel insulation board and the outer flanges of the wall panel studs of each of the wall panels, and into spaces at connections between the roof or floor panels and the upper ends of the wall panels, formed by recessing insulation boards of the wall panels, thereby forming a continuous concrete body from the roof or floor panel assembly to the wall assembly and joining the two assemblies into one monolithic composite insulated concrete wall and roof or floor system.

In a further aspect, the present invention is directed to a method of construction of a composite insulated concrete roof or floor system. The method comprises placing a plurality of insulation roof or floor panels of the present invention on supporting structures, with two opposing ends of each of the panels placed on top of and fastened to the supporting structures; providing reinforcing bars on top of the plurality of insulation roof or floor panels; and adding a sufficient amount of concrete on top of the plurality of insulation roof or floor panels, having the concrete filling into a space between the upper surface of the insulation board and the upper flanges of the studs of each of the roof or floor panels, covering the deformation resistant elements on the upper flanges of the studs and the reinforcing bars, and allowing the concrete to cure, thereby forming a composite insulated concrete roof or floor system.

The advantages of the present invention will become apparent from the following description taken in conjunction with the accompanying drawings showing exemplary embodiments of the invention.

BRIEF DESCRIPTION OF THE DRAWINGS

It is noted that in the drawings like numerals refer to like components.

DETAILED DESCRIPTION OF THE INVENTION

In one aspect, the present invention provides insulation roof or floor panels with built-in deformation resistant elements for a composite concrete roof or floor system.

Figure 1:
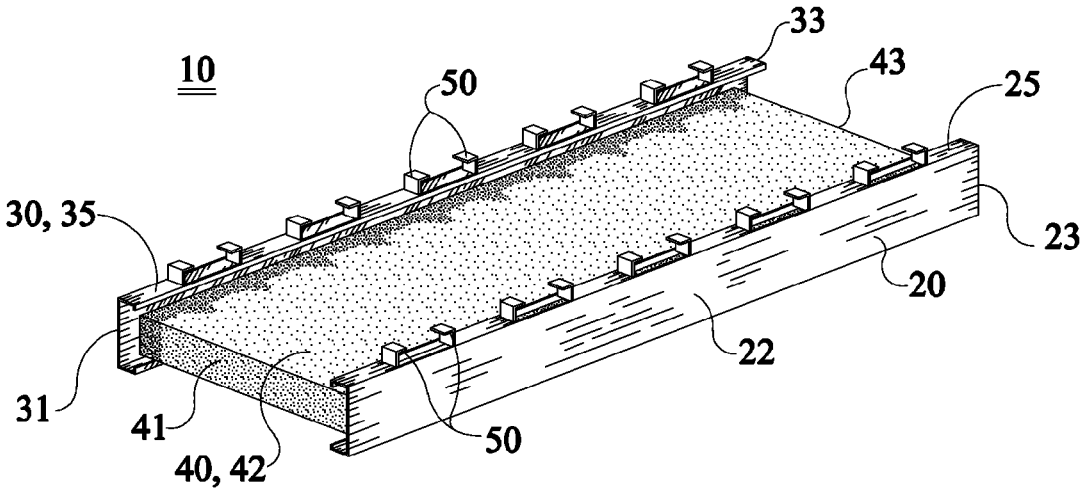
FIG. 1 is a top perspective view of a dual function insulation roof or floor panel in one embodiment of the present invention, adapted for construction of composite concrete roof or floor. The panel has a plurality of deformation resistance elements in the form of open rectangular brackets.
Figure 1A:
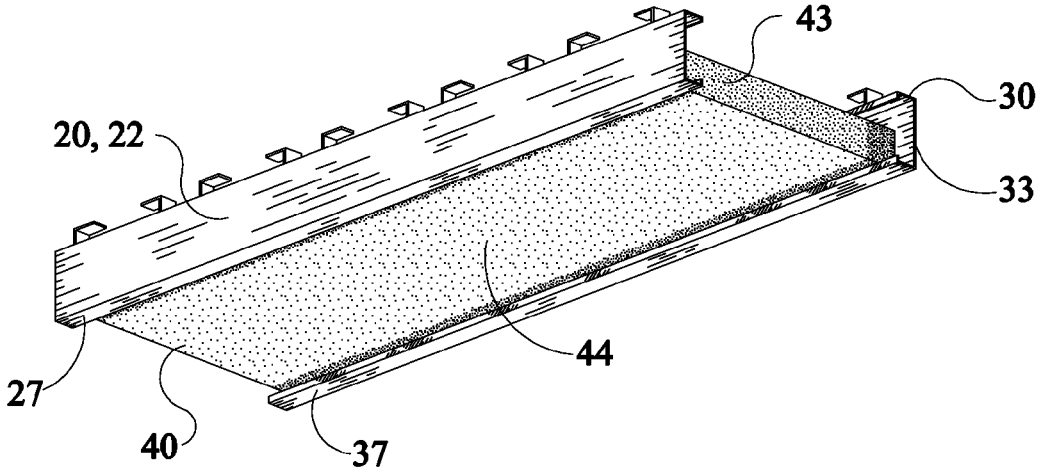
FIG. 1A is a bottom perspective view of the panel shown in FIG. 1, and FIGS. 1B, 1C and 1D are a side elevational view, a front elevational view and a top plan view of the panel shown in FIG. 1, respectively.
Figure 1B:
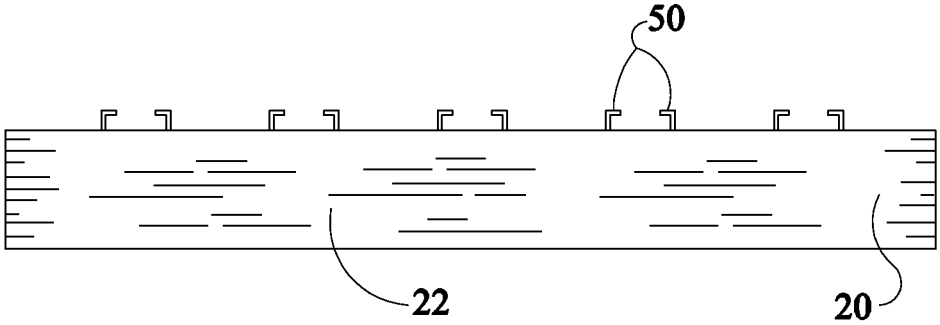
Figure 1C:
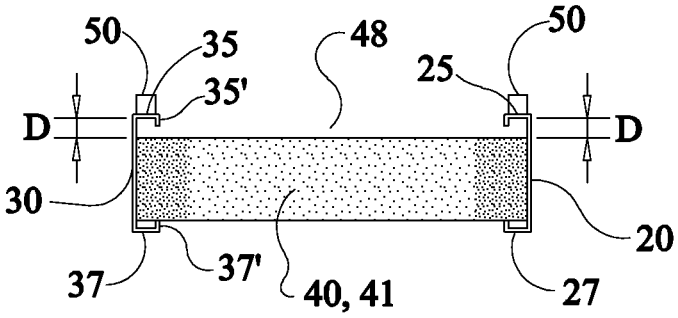
Figure 1D:
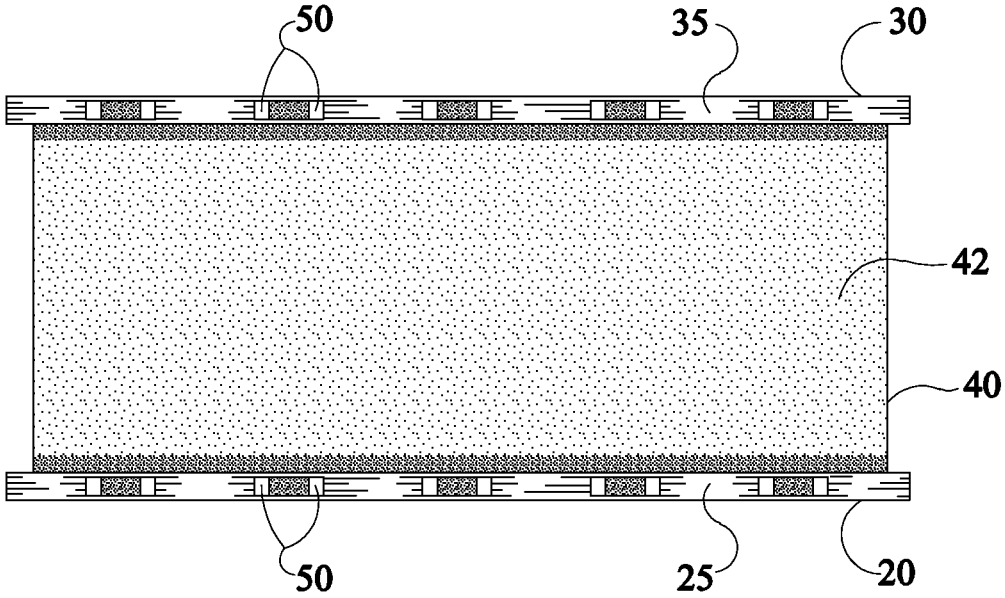

FIGS. 1 through 1D show a prefabricated insulation roof or floor panel 10 in one embodiment of the present invention. Since panel 10 of the present invention, as wells as variations thereof, can be used for construction of either a flat concrete roof or a concrete floor, it is referred to herein as a roof or floor panel, indicating its dual functionality. As shown in FIG. 1, insulation roof or floor panel 10 comprises a pair of elongated studs 20 and 30, each having a plurality of built-in deformation resistant elements 50, and an insulation board 40 secured between elongated studs 20 and 30.

As shown in FIG. 1, the elongated studs 20 includes a planar central web section 22 and two flanges 25 and 27 integrally extending from the web section 22. Because of the orientation of the roof or floor panel 10 when it is assembled in a building structure, flange 25 is herein referred to as an upper flange and flange 27 is herein referred to as a lower flange, respectively. In the embodiment shown, the elongated stud 30 is substantially a mirror image of the elongated stud 20, having a planar central web section 32, with an upper flange 35 and lower flange 37 integrally extending from the web section 32.

For the purpose of the present invention, the elongated studs can have a U-shaped or a C-shaped cross section. Preferably, studs having a C-shaped cross section, as shown in FIG. 1C, are used because of their structural strength, and these are also referred to as C-stud. As shown in FIG. 1C, with a C-stud 30 each flange member 35 or 37 further includes an edge flange 35' or 37'. The edge flanges 35' and 37' are substantially perpendicular to the corresponding flange members 35 and 37, respectively. The same applies to flange members 25 and 27 of stud 20.

The elongated studs can be made of any appropriate material, preferably made of metal, such as steel, plated or galvanized steel, cold formed or extruded metal. Preferably, plated or galvanized steel is used, since the roof or floor panels of the building structure must be capable of withstanding significant dead load and live load. The thickness or gauge of such materials may vary depending upon the size of the elongated studs, strength requirements of the buildings and engineer calculations. Typically, the elongated studs made of galvanized steel may have a thickness from about 25 to about 14 gauge, which is equivalent to from about 0.034 to about 0.0747 inch.

The length and width of the studs may vary depending upon the structure of a building, span between the supporting walls or structures, strength requirements, and the amount of insulating capacity desired. For most commonly used panels for housing and multi-story building constructions, the length of the stud can be from about 12 inches to about 20 feet, and the width of the panel (the distance between the web sections of two studs) can be from about 4 inches to about 4 feet. The web section of the elongated stud made of galvanized steel typically has a width from about 2 inches to about 12 inches; the flanges have a width from about 0.75 inch to about 4 inches, and the edge flanges (25' or 27') have a width from about 0.125 inch to about 1 inch. However, for small structures all dimensions mentioned above can be substantially smaller. The roof or floor panels of the present invention can also be used for substantially large building structures, such as warehouses, and can also be used for construction of bridges. For these large structures, the length of the stud can be up to about 60 feet, the width of the panel can be up to about 4 feet, the web section of the stud can have a width up to about 16 inches, and the flanges can have a width up to 4 inches.

In the embodiment shown in FIGS. 1 through 1D, the deformation resistant elements 50 are in the form of a pair of open brackets spaced apart on the upper flanges 25, 35 along the longitudinal direction of studs 20, 30. In this embodiment, brackets 50 are formed by punching through the upper flange of each stud, resulting a pair of reverse L-shaped brackets. Therefore, the brackets are integral parts of the studs, see FIGS. 1B and 1D. Alternatively, the brackets can also be affixed to the upper flange of the stud by welding, screws, bolts or pins, or by other suitable means.

Figure 4:
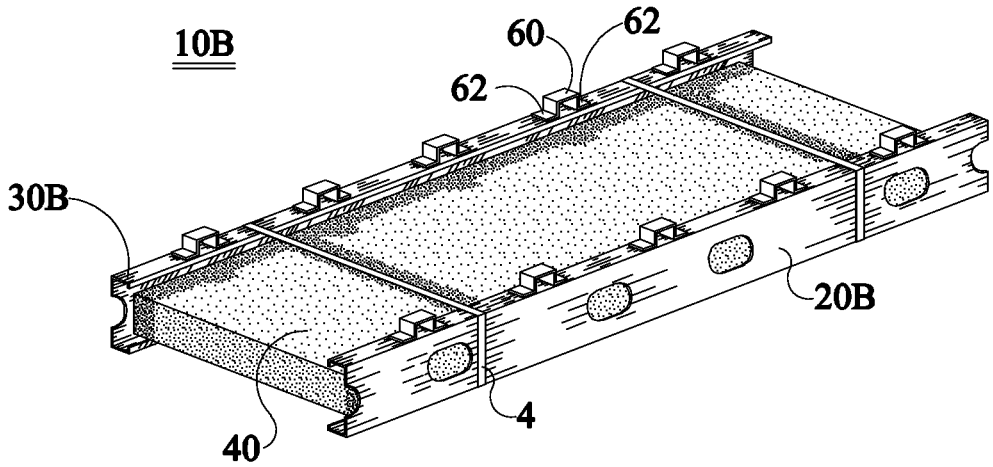
FIG. 4 is a perspective view of a dual function insulation roof or floor panel in a further embodiment of the present invention, having deformation resistance elements in the form of rectangular brackets.
Figure 5:
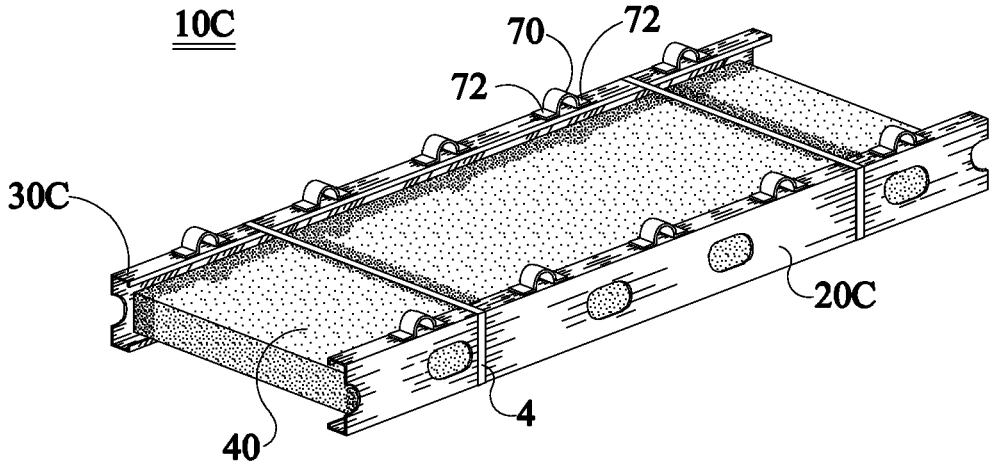
FIG. 5 is a perspective view of a dual function insulation roof or floor panel in another embodiment of the present invention, having deformation resistance elements in the form of semi-circular brackets.
Figure 6:
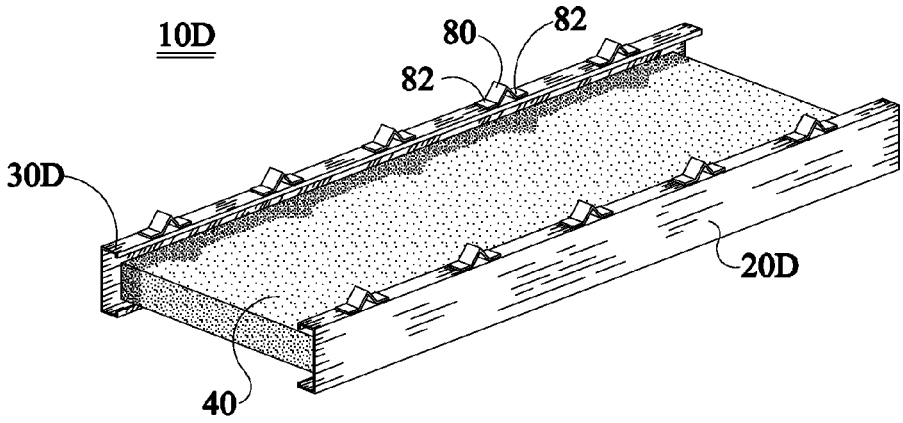
FIG. 6 is a perspective view of a dual function insulation roof or floor panel in a yet further embodiment of the present invention, having deformation resistance elements in the form of triangular brackets.

FIGS. 4 through 6 illustrate three alternative built-in deformation resistant elements. As shown in FIG. 4, roof or floor panel 10B includes a plurality of deformation resistant elements 60 spaced apart along the upper flanges of the studs 20B, 30B, in which deformation resistant elements 60 are in the form of bracket with a rectangular cross section. As shown in FIG. 5, roof or floor panel 10C includes a plurality of deformation resistant elements 70 spaced apart along the upper flanges of the studs 20C, 30C, deformation resistant elements 70 are in the form of bracket with a semicircular cross section. As shown in FIG. 6, roof or floor panel 10D includes a plurality of deformation resistant elements 80 spaced apart along the upper flanges of the studs 20D, 30D, in which deformation resistant elements 80 are in the form of bracket with a triangular cross section. In these embodiments, each bracket has a pair of base flanges, namely bracket 60 has base flanges 62, bracket 70 has base flanges 72 and bracket 80 has base flanges 82, respectively.

Figure 7:
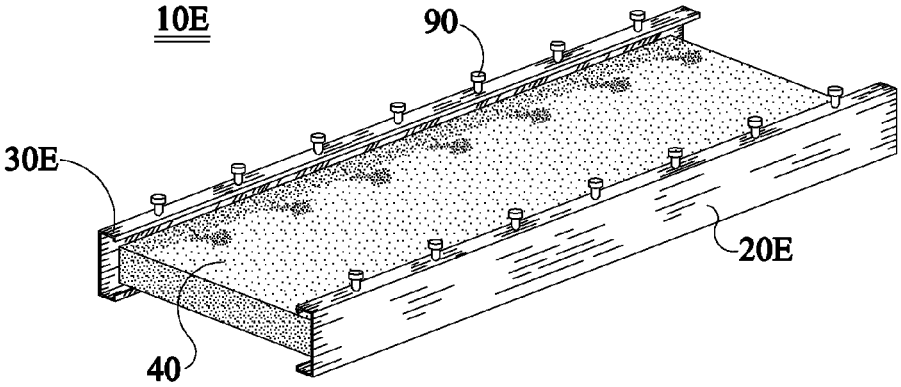
FIG. 7 is a perspective view of a dual function insulation roof or floor panel in a further embodiment of the present invention, having deformation resistance elements in the form of pins.

FIG. 7 illustrates another alternative embodiment of the deformation resistant elements. As shown, roof or floor panel 10E includes a plurality of deformation resistant elements 90 in the form of headed pin spaced apart along the upper flanges of the studs 20E, 30E.

It should be understood that in addition to the examples shown in FIGS. 1 and 4-7, other suitable shapes and configurations can also be used for the deformation resistant elements, for example, square shape brackets, straight pin, etc. The deformation resistant elements can be integral parts of the studs, as shown in FIG. 1. In the embodiments shown in FIGS. 4-7, the brackets 60-80 or pins 90 can be affixed to the upper flange of each stud by welding, screws, bolts or pins. Other suitable means can also be used to affix the deformation resistant elements, for example, locking the bracket onto the upper flange through slots or grooves provided on the surface of the upper flange, or inserting pins into holes or slots provided on the upper flange of the stud. The brackets and pins can be affixed onto the studs in the manufacturing process of the prefabricated roof or floor panels, and alternatively, they can also be affixed to the studs by construction workers at the construction site. As described hereinafter, the panels always have a distance between the insulation board and the upper flange of the stud in the panel, the brackets and pins can be attached to the upper flange of the stud at the construction site without affecting the structure of the panels.

Figure 6A:
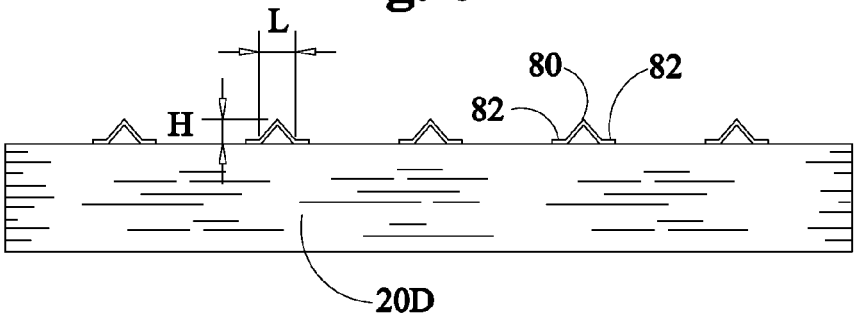

The number of deformation resistant elements provided on each stud may vary depending on the length of stud and the load of the roof or floor structure. Typically, the distance between the deformation resistant elements can be from about 4 inches to about 12 inches. The length of the bracket "L", in the longitudinal direction of the stud, can be from about 0.5 inch to about 4 inches. The width of the bracket, within the width of the upper flange, can be from about 0.5 inch to about 3 inches, and the height of the bracket "H", from the surface of the upper flange to the top end of the bracket, can be from about 0.5 inch to about 2 inches, see FIG. 6A. However, for large building structures as discussed above, the dimensions of the brackets can increase substantially, for example, the length, width and height can be up to 12 inches, 4 inches, and 12 inches, respectively.

The deformation resistant elements can be made of any appropriate material, preferably made of metal, such as steel, plated or galvanized steel, cold formed or extruded metal. Preferably, they are made of the same material of the stud. In panels 10-10D, the thickness of the brackets can be similar to the thickness of the stud. In panel 10E, the headed pin 90 can have a width of from about 0.5 inch to about 2 inches, and a height same as that of the brackets described above.

The roof or floor panels of the present invention are used for construction of a composite concrete roof or floor system. As further described hereinafter, during construction concrete is poured on to the panels in a roof or floor panel assembly, the upper flanges of the studs and deformation resistant elements described above are all buried in concrete, and become integral parts of the formed composite system. It has been found that within such a composite system, the brackets and pins 50-90 affixed on the upper flanges of the studs assert shearing action in the concrete, which enhances the resistance of the composite floor or roof to deformation, particularly deflection in the vertical direction.

Figure 3:
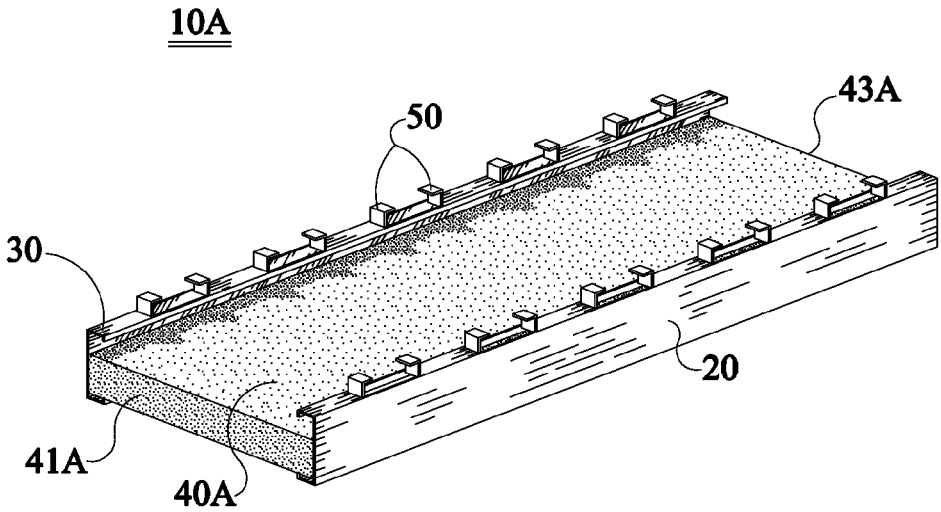
FIG. 3 is a perspective view of a variation of the insulation roof or floor panel shown in FIG. 1, with the insulation board flush with the two studs of the panel.

As shown in FIGS. 1 and 1A, insulation board 40 has an upper surface 42, a lower surface 44, and two ends 41 and 43. As shown in FIGS. 1 and 1C, insulation board 40 is disposed between elongated studs 20 and 30, with two side edges against the internal surface of web sections 22 and 32 of the studs. In the embodiment shown in FIG. 1, insulation board 40 is slightly shorter in length than the studs, as such ends 41 and 43 of the insulation board recess from the corresponding ends of the studs. Preferably, the distance of the recess can be from about 0.125 inch to about 6 inches. The recessed space allows filling of concrete during construction to facilitate integration of the composite structure. However, in an alternative embodiment as shown in FIG. 3, insulation board 40A in panel 10A has the same length as the two studs and both ends 41A and 43A of the insulation board 40A flush with the corresponding ends of the studs. This configuration is used for certain structures where concrete is not filled in at the ends of the panel.

Insulation board 40 has a thickness (between upper surface 42 and lower surface 44) less than the width of web section 22, 32 of the studs. The lower surface 44 of insulation board 40 is disposed against lower flanges 27 and 37 of studs 20 and 30, thereby establishing a distance D between upper surface 42 of insulation board 40 and upper flanges 25 and 35 of studs 20 and 30 through the length of the studs (see FIGS. 1 and 1C). Typically, the thickness of insulation board 40 is from about ⅔ to about ⅞ of the width of web section of the studs, such that distance D is from about ⅛ to about ⅓ of the width of web section of the studs.

As shown in the top perspective view and the front view of panel 10 as illustrated in FIGS. 1 and 1C, in the presence of distance D on both sides of panel 10, the panel has a hollow space 48 across upper surface 42 of insulation board 40 in both longitudinal and lateral directions. In panel 10, the side of the panel having the space is referred to as the top side and the opposing side is referred to as the bottom side. The hollow space 48 will be filled with concrete during construction to form a composite concrete roof or floor, as described in details hereinafter. Preferably, insulation board 40 is planar, with the upper and lower surfaces in parallel. In such a configuration, distance D is substantially uniform throughout the length of the studs, and space 48 has the same depth throughout of the insulation board. The thickness of insulation board 40, as well as distance D, can be determined based on the size of the studs, strength requirements of a roof or floor system, the amount of insulation capacity desired, and other structural considerations.

Insulation board 40 may be constructed of any material which provides thermal and/or acoustical insulation including, for example, polymeric materials, such as polystyrene, polyurethane, and composites. Moreover, the material can be cut by knife, or is heat deformable, or both. The heat deformable material does not produce smoke or toxic gas. Preferably, rigid polymeric foams, such as expanded polystyrene foam (EPS) or polyurethane foam, are used.

Figure 2:
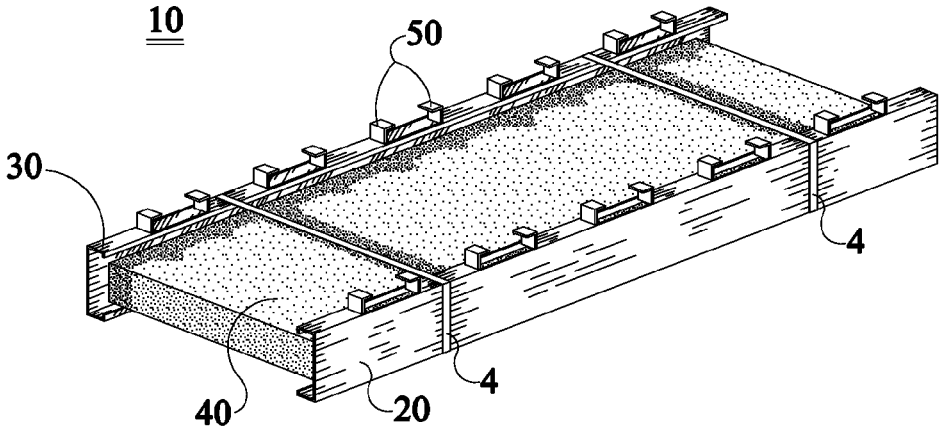
FIG. 2 is a perspective view of the insulation roof or floor panel shown in FIG. 1, further including two strapping bands wrapped around the panel.

The elongated studs 20 and 30 and insulation board 40 are fastened together by fastening means. Suitable fastening means include, but not limited to, adhesives, screws, pins and strapping bands. When adhesives, screws and pins are used, these fastening means can be provided at the interfaces between the insulation board and the elongated studs to hold the insulation board and the studs together. In the embodiment shown in FIG. 2, panel 10 may further include two strapping bands 4 that fasten around studs 20 and 30 to tightly hold insulation board 40 and the studs together. The strapping band can be made of any suitable materials, such as sheet metal, plastics such as nylon, vinyl, and fiberglass. In one exemplary embodiment, a vinyl strap having a width from about ½ to 1 inch is used. Alternatively, the panel can also be formed by injecting foam between the two studs placed in a mold, which forms an integral panel structure.

Optionally, roof or floor panel 10 can further include one or more spacers disposed on each side of the panel between upper surface 42 of insulation board 40 and upper flanges 25 and 35 of the studs. The spacers assist in maintaining distance D during transportation and construction. The spacers can have any suitable structure and shape, such as block, wedge and bracket. Preferably, the surface of the spacer in contact with the insulation board is planar. The spacers can be made of any suitable materials, including but not limited to, metal, plastics, and wood. The spacers can also be tabs formed by stamping or punching the stud.

Figure 8:
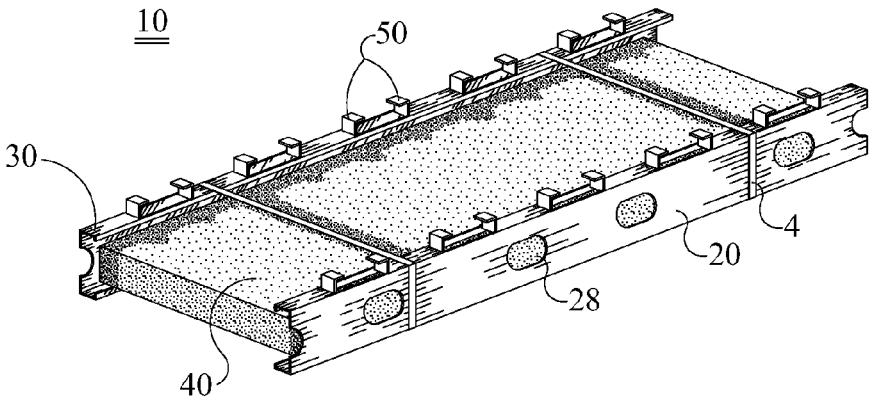
FIG. 8 is a perspective view of the insulation roof or floor panel shown in FIG. 1, further including a plurality of through-holes on web sections of the studs of the panel.
Figure 8A:
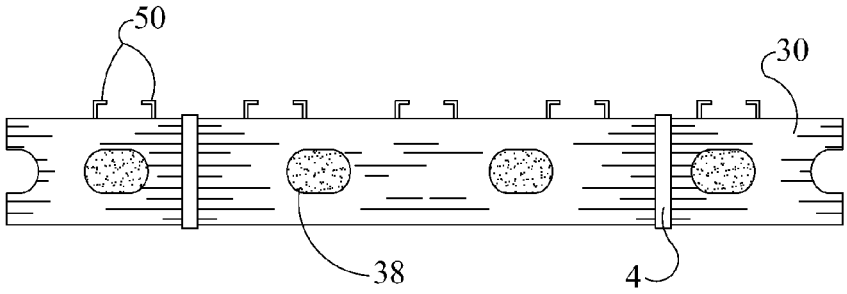
FIG. 8A is a side elevational view of the panel shown in FIG. 8.

In a further embodiment, as shown in FIGS. 8 and 8A, each elongated stud of panel 10 may further include multiple through-holes 28, 38 on the planar web section 22, 32, spaced apart along the length of the stud. The multiple through-holes within each stud are spaced apart with a predetermined distance along the length of the stud. Since these multiple through-holes are used for placing utilities such as electrical wires, cables and plumbing pipes for the buildings, as further described hereinafter, typically they are spaced apart in an increment of 8 inches, or 16 inches. However, the distance between two adjacent through-holes in the longitudinal direction can be different, so long as a pair of through-holes between studs 20 and 30 are aligned in the longitudinal direction of the panel. The through-holes can have various shapes, such as circular, elliptical, square, rectangular, and triangle. Preferably, the through-holes have smoothed corners as shown in FIG. 8, to avoid uneven force distribution at the sharp corners. For placing utilities, the through-holes typically have a length (along the length of the stud) from about 1.25 to about 6 inches, and a height from about 1.25 to about 4.25 inches.

Multiple through-holes 28, 38 may be disposed at the center of the web section between the upper and lower flanges, or disposed off the center and closer to lower flange 27, 37 than to the upper flange 25, 35. Preferably, multiple through-holes 28, 38 on each stud are aligned along their centerline that is a parallel with the longitudinal axis of the panel. Each pair of through-holes between the two studs is also aligned in the transverse direction of the panel, namely in the direction from the lower flange to the upper flange of the web section of the stud. Preferably, the thickness of insulation board 40 is sufficient to have its side edges covering all through-holes 28 and 38 on the web sections of both studs, as shown in FIGS. 8 and 8A. As such, when concrete is poured on top of insulation board 40 during construction, the through-holes 28, 38 on the web sections of the two studs are not in contact with the concrete. The presence of these through-holes on the web section of the studs provides a convenient access for arrangement of building utilities after the roof or floor is constructed.

This unique structural feature of the roof or floor panels of the present invention provides freedom and flexibility in utility arrangement.

Figure 9:
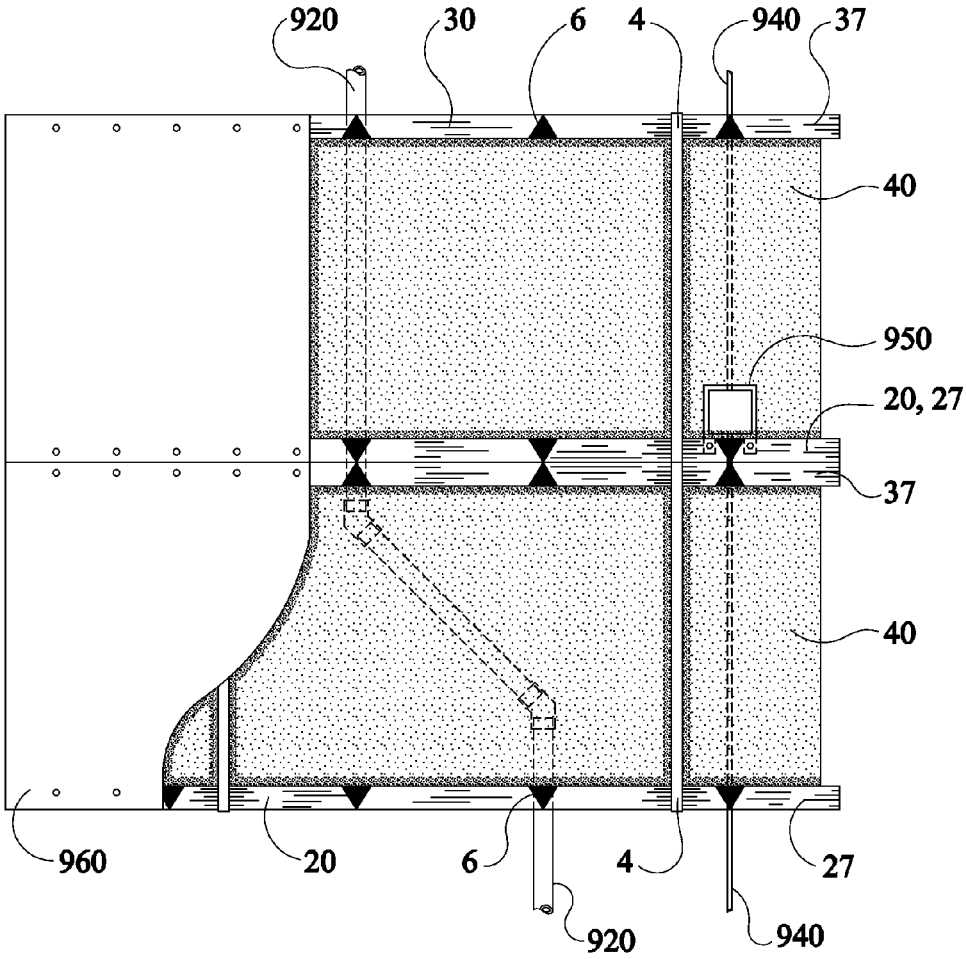
FIG. 9 is a cut away view showing the lower side of two panels shown in FIG. 8 in a floor assembly, with plurality of alignment markings provided on the lower flanges of the studs to assist alignment of adjacent panels and placement of plumbing and pipes for electrical wires.

As shown in FIG. 9, optionally each of the studs 20, 30 further includes alignment markings 6 on the external surface of lower flange 27, 37. The alignment markings 6 are provided at the same position of the through-holes in the longitudinal direction. As such, when multiple roof or floor panels are assembled in construction as further described hereinafter, the through-holes on the web section between adjacent panels can be aligned conveniently and accurately with the assistance of the alignment markings. This enhances construction quality and speed. The alignment markings can be provided by printing, painting, stamping, embossing, or other suitable methods. In the embodiment shown in FIG. 9, the alignment markings 6 have a triangle shape with one angle aligned with the center of the through holes. Any other suitable shapes, such as arrow, line, and diamond can also be used.

As further described hereinafter, utilities such as plumbing pipes and electrical wires, cables, etc. can be placed in the insulation board passing through the through-holes on the web sections of the studs among multiple panels, as shown in FIG. 9. As shown, once two adjacent panels are installed next to each other, the through-holes on the web sections of the studs are no longer visible from either the upper or lower side of the panels. However, the alignment markings 6 indicate the positions of the through-holes to the construction works, and therefore, assist placement of utilities through the panels. This can be further appreciated from FIG. 10, which illustrates two installed roof or floor panels 10 in a flat roof or floor assembly, with plumbing and pipes for electrical wires placed through the through-holes 28 and 38 of the two panels. As shown, at the bottom side of the roof or floor panel assembly the alignment markings 6 on the lower flanges clearly indicate the position of through-holes 28 and 38 in each panel 10.

Figure 11:
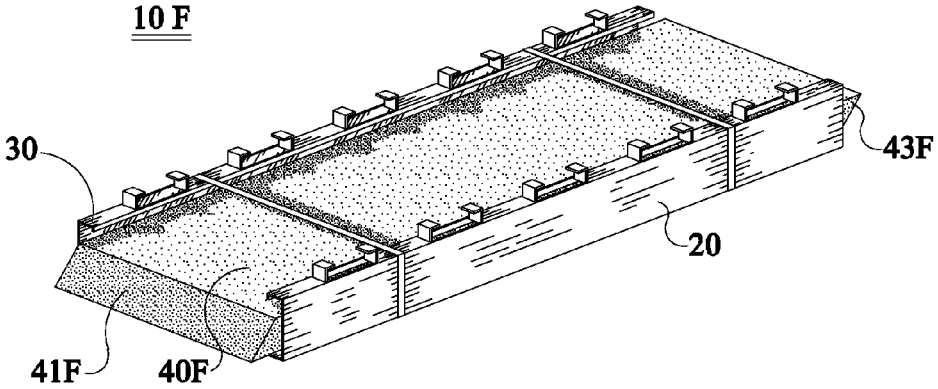
FIG. 11 is a perspective view of an insulation roof panel in a further embodiment of the present invention, in which two ends of the insulation board have an inclined surface for placement in an inclined roof.
Figure 11A:
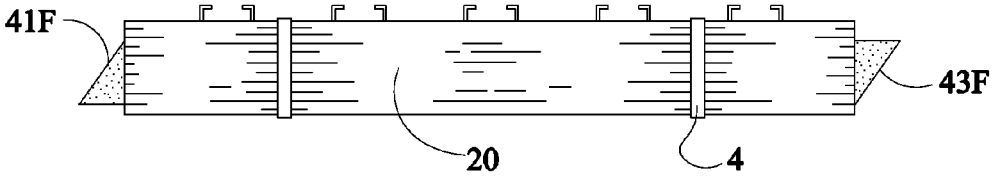
FIG. 11A is a side view of the panel shown in FIG. 11.

In the embodiments shown above, the roof or floor panel 10 has a general rectangular shape, which is suitable for construction of flat roofs and floors. The present invention further provides panels with variations in shape or configuration for construction of inclined concrete roofs. FIGS. 11 and 11A illustrate panel 10F in one embodiment. As shown, in panel 10F insulation board 40F has ends 41F and 43F aligned with both ends of studs 20 and 30, however, both ends 41F and 43F have an inclined surface, which differ from vertically straight ends in panel 10 or 10A shown in FIGS. 1 and 3. As can be appreciated from FIG. 11A, the inclined surface of end 43F is complimentary to the inclined surface of end 41 F. When two panels are placed along the longitudinal axis of the panels, the complimentary inclined surfaces mate with each other and form a continuous interface between the two panels.

Figure 12:
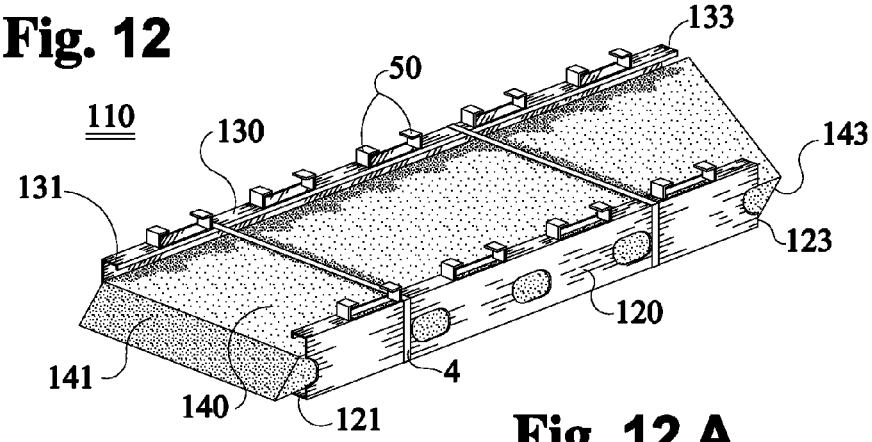
FIG. 12 is a perspective view of an insulation roof or floor panel in another embodiment of the present invention, in which one stud extends beyond the other stud at one end of the panel, and the two ends of the panel are asymmetric.
Figure 12A:
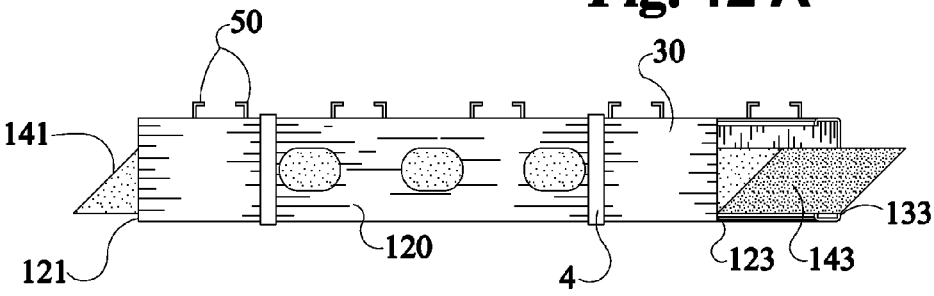
FIG. 12A is a side view of the panel shown in FIG. 12, viewed from the side of the shorter stud.

FIGS. 12 and 12A illustrate another embodiment. As shown, panel 110 has two studs 120 and 130 of different lengths. At one end of the panels, ends 121 and 131 of the two studs are aligned with each other, while at the opposing end, end 133 of stud 130 extends beyond end 123 of stud 120. Insulation board 140 has one end 141 aligned with the ends of the two studs, yet with an inclined surface same as the end in panel 10F described above, while at the opposing end 143, the insulation board is angled, tapering from the end 133 of stud 130 to end 123 of stud 120. Therefore, panel 110 is asymmetric. Moreover, end 143 further has an inclined surface, see FIG. 12A. Panel 110 can be used for joining roof panels at corners of an inclined roof.

Figure 13:
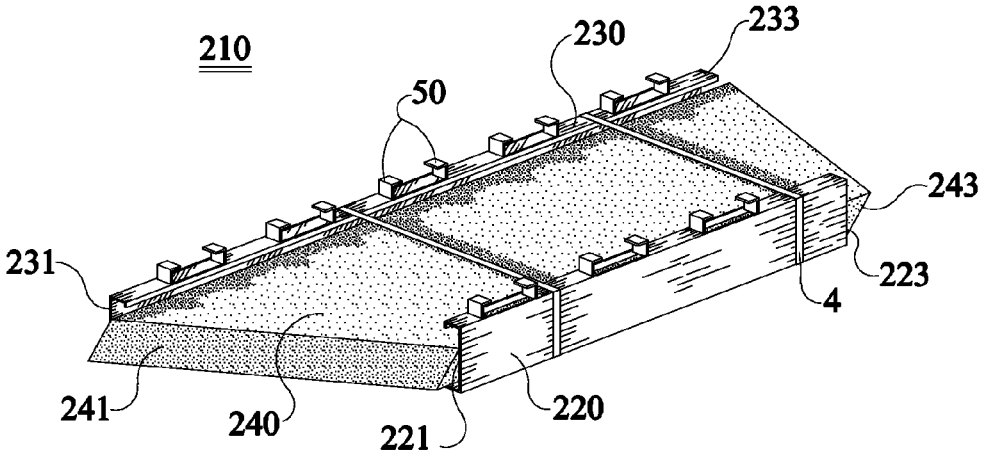
FIG. 13 is a perspective view of an insulation roof or floor panel in yet another embodiment of the present invention, in which one stud extends beyond the other stud at both ends of the panel, and both ends of the panel are angled.
Figure 13A:
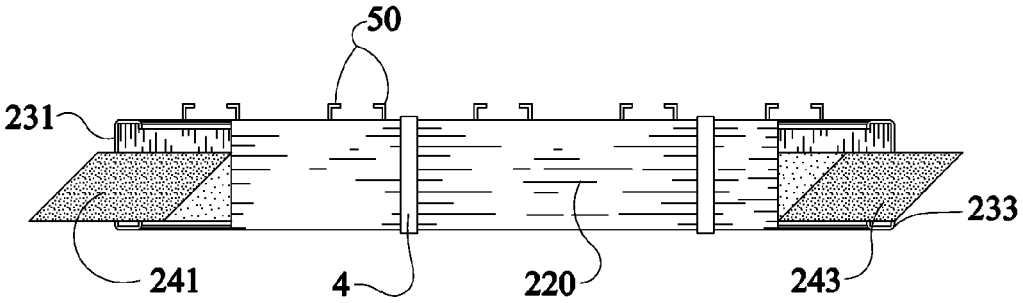
FIG. 13A is a side view of the panel shown in FIG. 13, viewed from the side of the shorter stud.

FIGS. 13 and 13A illustrate a further embodiment. As shown, panel 210 also has two studs 220 and 230 of different lengths. Different from panel 110, the two studs are not aligned at either end. The ends 231 and 233 of stud 230 extend beyond ends 221 and 223, respectively. Insulation board 240 are inclined at both ends 241 and 243, namely end 241 tapering down from end 231 of stud 230 to end 221 of stud 220 at one end, and end 243 tapering down from end 233 of stud 230 to end 223 of stud 220 at the opposing end. Moreover, both ends 241 and 243 have an inclined surface, yet in a complimentary manner, see FIG. 13A. Panel 210 can also be used for joining roof panels at corners of an inclined roof.

Figure 14:
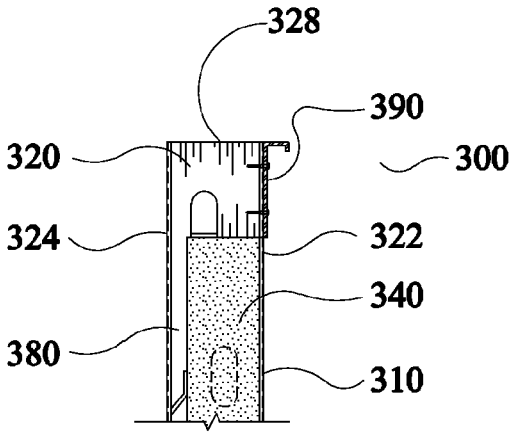
FIG. 14 illustrates a top portion of a wall panel in an installed wall assembly before placement of the floor panels of the present invention.

In a further aspect, the present invention provides a method of construction of composite or integrated roof or floor system using the roof or floor panels of the present invention. FIGS. 14-17 illustrate an example process in construction of a flat roof or a floor in a multi-story building using the roof or floor panel 10 shown in FIG. 1. As shown in FIG. 14, before construction the flat roof or floor, a wall assembly 300 is provided. In FIG. 14, a cross section of the top portion of one wall panel 310 is shown, and the rest of the wall assembly extending behind the wall panel 310. The structures of wall panel 310 and the wall assembly 300 are described in U.S. patent application Ser. No. 12/542,150, which is hereby incorporated by reference in its entirety. Briefly, wall panel 310 is formed of two C-studs (only one of them 320 is shown in FIG. 14) with an insulation board 340 secured between the two C-studs. The insulation board 340, with thickness less than the width of the web portion of the C-stud, is disposed directly against the inner flange 322 of the C-stud, with a distance from the insulation board 340 to the outer flange 324 of the C-stud, which results in a hollow space 380. As shown, a L-shaped anchoring bracket 390 are affixed to the inner flange 322 of C-stud 320 against the top end 328 of the C-stud, and the same is also provided to all C-studs of the wall panels in wall assembly 300.

Figure 15:
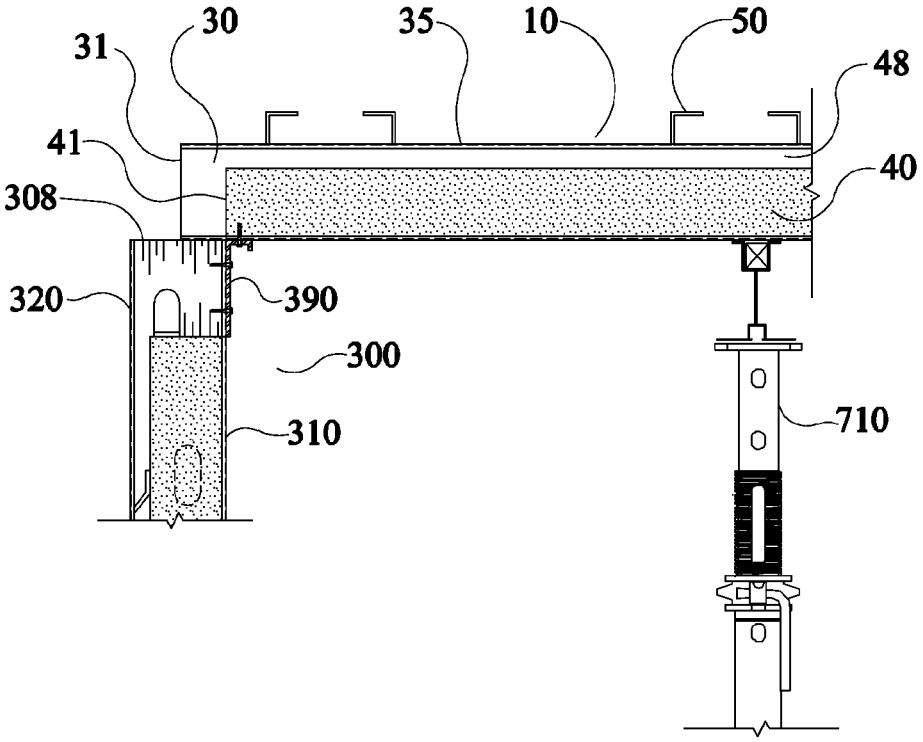
FIG. 15 illustrates the floor panels of the present invention being placed on top of the wall assembly shown in FIG. 14.

As shown in FIG. 15, multiple roof or floor panels 10 of the present invention are then placed on top of the wall assembly 300, forming a roof or floor panel assembly, which is temporarily supported from underneath by multiple shoring 710. In FIG. 15, only a partial cross section of one roof or floor panel 10 is shown to illustrate the connection between the roof or floor panels and the wall assembly. As shown, the end 31 of stud 30 of panel 10 is rested on the top end 328 of C-stud 320 of the wall panel 310, and the lower flange 37 of stud 30 is affixed to the L-shaped anchoring bracket 390 by fasten means, such as screws, pins or bolts.

Figure 16:
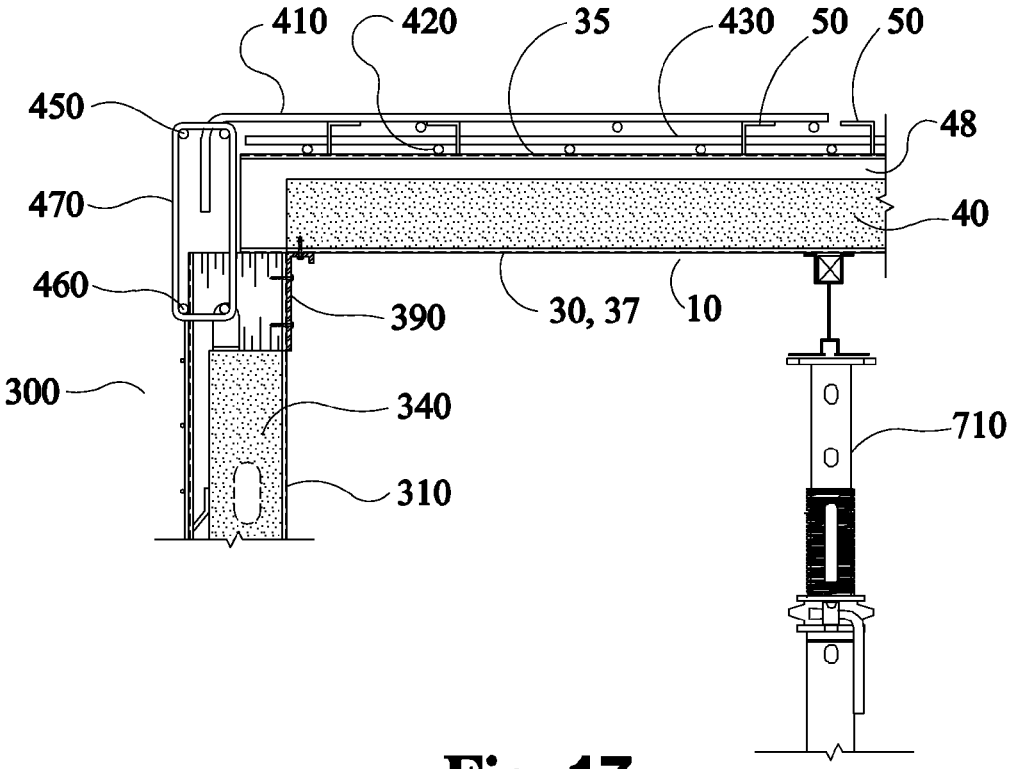
FIG. 16 illustrates subsequently rebar being placed on top of the floor panels and at the connections between the wall assembly and the floor panels.

As shown in FIG. 16, then reinforcing bars 410, 420 and 430 are placed on top of the roof or floor panel assembly. At the connections between the roof panels and the wall panels, reinforcing bars 450, 460 and 470 are used to reinforce the connections between the wall assembly and roof or floor panel assembly in a composite structure.

Figure 17:
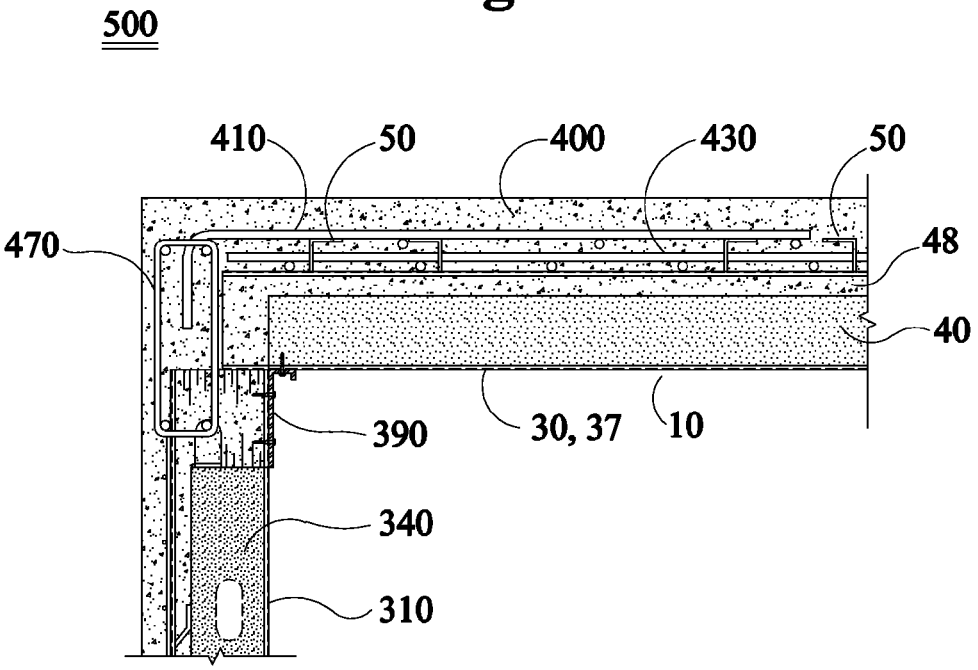
FIG. 17 illustrates concrete being poured onto the floor panels and into the wall assembly to form an integrated floor and wall structure.
Figure 18:
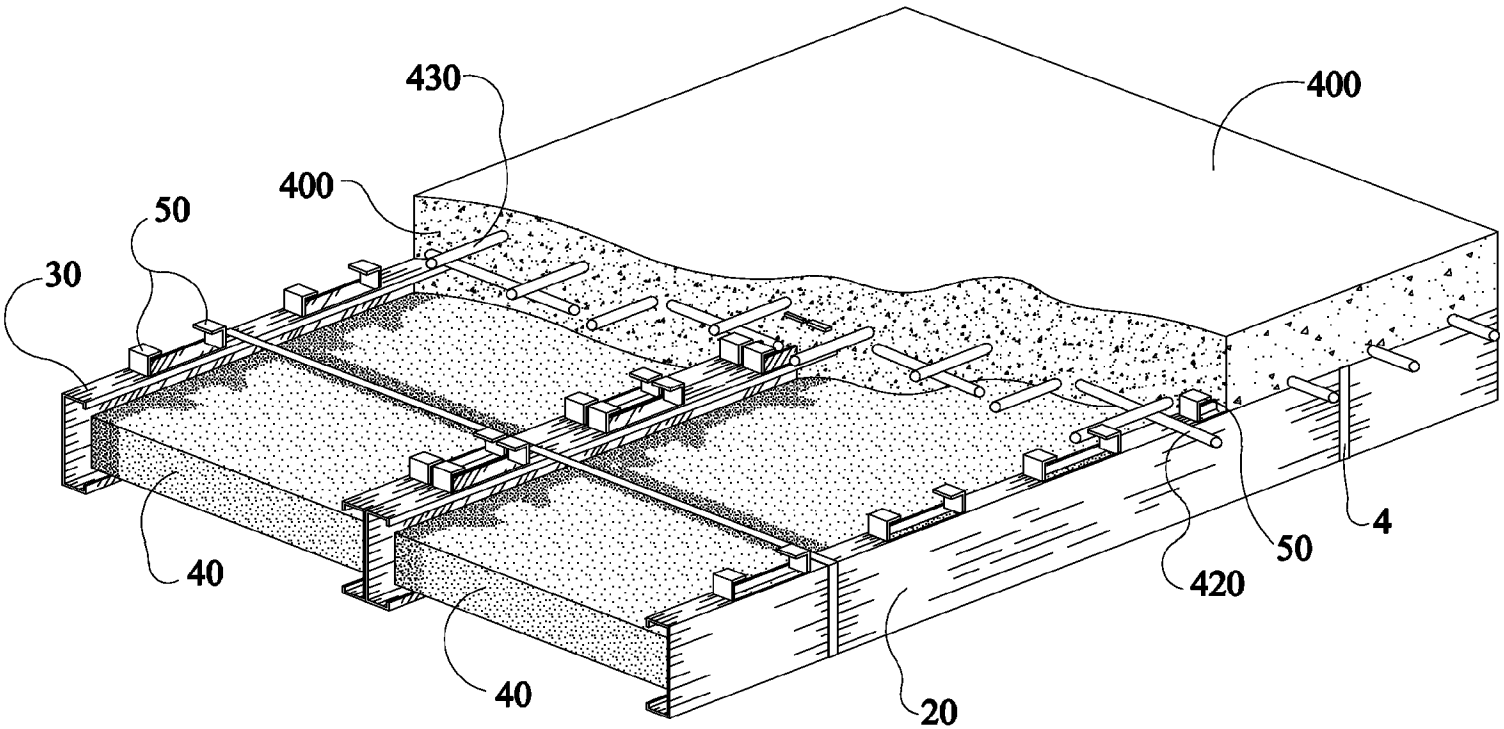
FIG. 18 is an illustrated cut away view showing internal structure of the composite concrete floor formed using the floor panels of the present invention.

Subsequently, as shown in FIG. 17, concrete 400 is poured on to the roof or floor panel assembly and also into the wall assembly. As shown, concrete 400 fills in the space 48 between the insulation board 40 and the upper flange 35 of the stud 30, into the space between the end 31 of stud 30 and the end 41 of insulation board 40 (see the ends in FIG. 15), and into the space 380 within the wall panel 310 described above (see FIG. 14). Same as the reinforcing bars, brackets 50 are buried into concrete 400. As the concrete cures, a composite roof or floor system 500 is formed, in which metal studs, concrete, insulation boards and reinforcing bars are integrated all together. This composite structure can be more clearly visualized in FIG. 18. As shown, the concrete layer starts from the upper surface of the insulation board 40, with an integral portion of the concrete within the hollow space between the upper surface of the insulation board and the upper flanges the studs.

In the example shown, because the wall assembly 300 is used, the formed composite roof or floor system 500 is further integrated with the walls of the building, which forms a monolithic building structure. It should be understood that although the wall assembly 300 is used in the example to demonstrate a preferred monolithic building structure, other wall panels and assemblies can also be used together with the roof or floor panels of the present invention.

Once the composite roof or floor system is established using the process described above, utilities such as electrical wires, telephone and television cable, electricity sockets, and plumbing pipes can be attached to the roof or floor panel assembly by direct attachments to the lower flanges of the studs of the panels.

Figure 10:
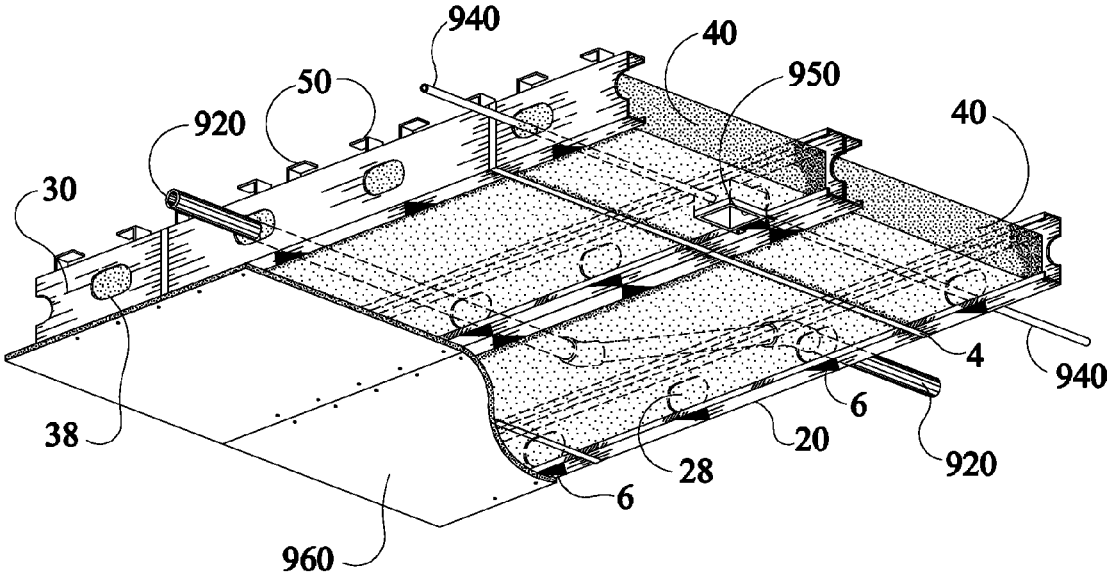
FIG. 10 illustrates the bottom side of two panels shown in FIG. 8 in a floor assembly, showing alignment of the through-holes on the web section of the studs between two adjacent panels and placement of pipes for electrical wires, socket and plumbing in the insulation boards of the panels as well as their passing through the through-holes on the studs.

In the process illustrated in FIGS. 14-17, panels 10 shown in FIG. 1 are used. As described above, panel 10 can further include multiple through-holes 28, 38 on the web section of the studs as shown in FIG. 8. As can be appreciated, when panels 10 including through-holes 28, 38 are used, once the composite roof or floor system is established using the process described above, utilities such as electrical wires, telephone and television cable, electricity sockets, and plumbing pipes can be placed into the roof or floor panel assembly, as illustrated in FIG. 10. As described previously, the insulation board 40 is made of a material which is either heat deformable or can be cut by knife. Once the location of a specific utility is determined, construction workers can use a hot air blower or a knife to create one or more grooves or open channels on the lower surface 44 of the insulation board for placing the utility within the floor panel assembly. Once the groove is created, specific through-hoses 28 and 38 in the path of the groove are unobstructed and can be accessed from the bottom side of the floor panel assembly. In the example shown in FIG. 10, a plumbing pipe 920 and pipe 940 for electric wires are placed in insulation boards 40, crossing horizontally between adjacent floor panels. Moreover, a casing 950 for electrical wires is also placed into insulation board 40.

As described above, the insulation board has a thickness sufficient to cover the through-holes on the web section of the studs when the insulation board is disposed against the lower flange. As such, when the roof or floor is constructed, the insulation board prevents concrete to enter or block the through-holes. Such a structural feature ensures that the through-holes are fully available for placement of utilities.

After the desired utilities are placed into the roof or floor panel assembly, interior finish, such as the ceiling board 960 as shown in FIG. 10, can be directly attached to the lower flanges of the studs of the roof or floor panels using fastening means known in the art.

Figure 19:
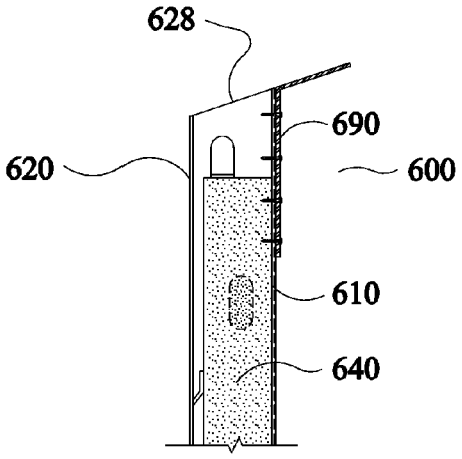
FIG. 19 illustrates a top portion of a wall panel in an installed wall assembly before placement of the roof panels of the present invention in construction of an inclined roof.

FIGS. 19-22 further illustrate an example of construction of an inclined composite concrete roof system using the roof panels of the present invention. As shown in FIG. 19, before construction of an inclined roof, a wall assembly 600 is provided. In FIG. 19, a cross section of the top portion of one wall panel 610 is shown, and the rest of the wall assembly extending behind the wall panel 610. The structure of wall panel 610 is generally the same as the structure of wall panel 310 described above, except that the top end 628 of the C-studs (only one of them 620 is shown in FIG. 19) is inclined, with the same slope of the subject inclined roof. Moreover, the top portion of the anchoring bracket 690, affixed to C-stud 620, is also inclined with the same slope.

Figure 20:
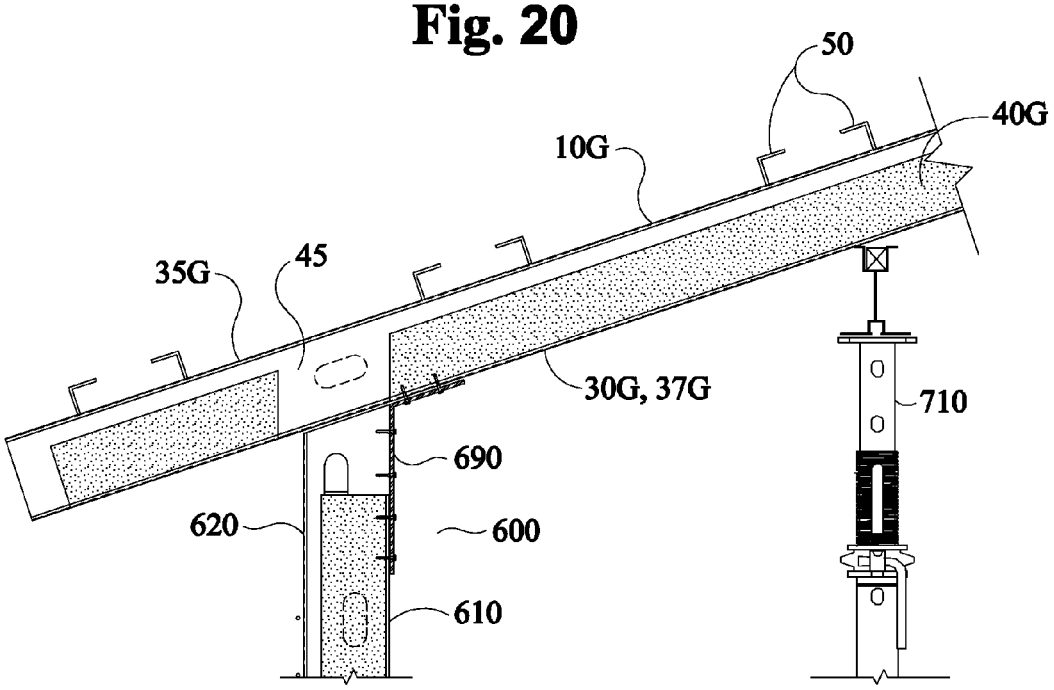
FIG. 20 illustrates the roof panels of the present invention being placed on top of the wall assembly shown in FIG. 19.

As shown in FIG. 20, multiple roof panels 10G of the present invention are then placed on top of the wall assembly 600, forming a roof panel assembly, which is temporarily supported from underneath by multiple shoring 710. In FIG. 20, only a partial cross section of one roof panel 10G is shown. As shown, roof panel 10G includes an insulation board 40G that has a gap 45 between two segments of the insulation board. In construction, roof panel 10G is so positioned that the gap 45 is above the wall assembly 600. As further shown, at the position of gap 45, stud 30G further includes a through-hole 39, which is used for placing additional reinforcing elements for the composite roof. The lower flange 37G of stud 30G is affixed to the anchoring bracket 690 by fasten means, such as screws, pins or bolts.

Figure 21:
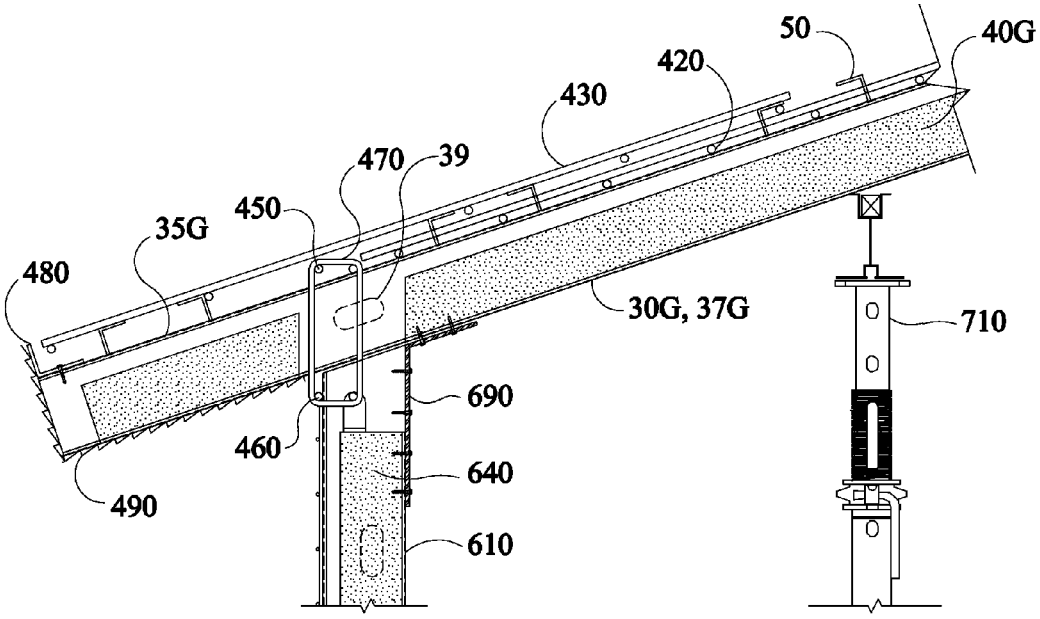
FIG. 21 illustrates subsequently rebar being placed on top of the roof panels and at the connections between the wall assembly and the roof panels.

As shown in FIG. 21, then reinforcing bars 420 and 430 are placed on top of the roof panel assembly. At the connections between the roof panels and the wall panels, reinforcing bars 450, 460 and 470 are used to reinforce the connections between the wall assembly and roof panel assembly in the composite structure. Furthermore, a L-shaped bracket 480 is attached to the end of the upper flange 35 by fasten means, which forms a closure at the lower end of the roof system. Moreover, an expanded metal lath 490 is attached at the lower end of roof panel 10G, which is provided for attaching stucco.

Figure 22:
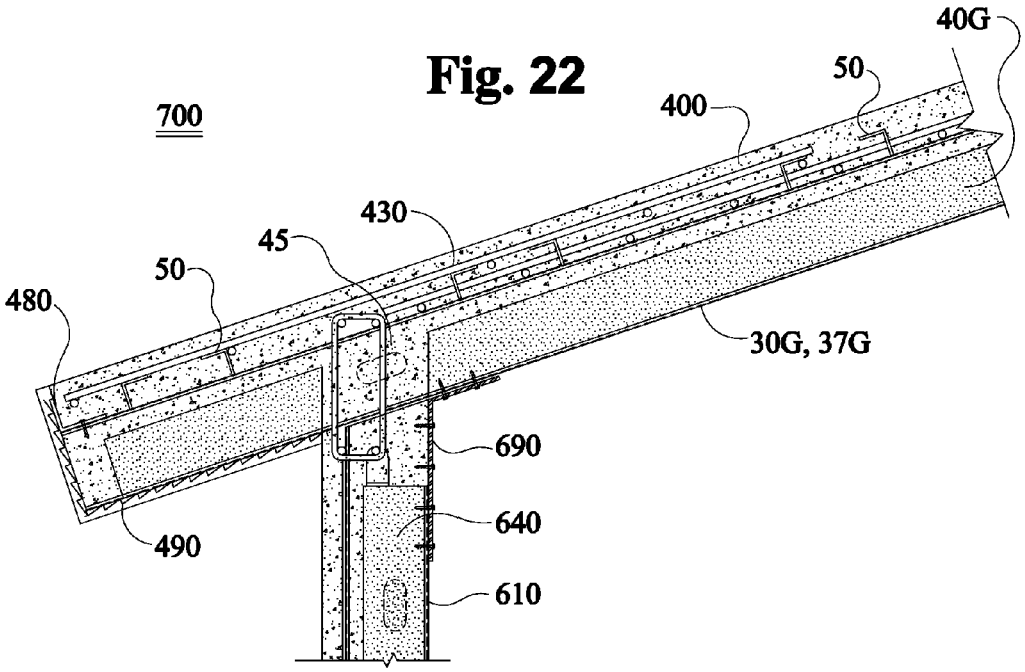
FIG. 22 illustrates concrete being poured onto the roof panels and into the wall assembly to form an integrated roof and wall structure.

Subsequently, as shown in FIG. 22, concrete 400 is poured on to the roof panel assembly. As shown, concrete 400 fills in the space between the insulation board and the upper flange of stud 30G, into the gap 45 between the two segments of insulation board 40G, and into the space within the wall panel 610. Same as the reinforcing bars, brackets 50 are buried into concrete 400. As the concrete cures, a composite inclined roof system 700 is formed, which integrates metal studs, concrete, insulation boards and reinforcement reinforcing bars all together. In the example shown, because the wall assembly 600 is used, the formed composite roof system 700 is further integrated with the walls of the building, which forms a monolithic building structure. It should be understood that although other wall panels and assemblies can also be used together with the roof panels of the present invention.

It has been found that the composite roof or floor system constructed using the roof or floor panels and the process of the present invention has a substantially improved resistance to deformation, particularly deflection in the vertical direction, in comparison to the existing composite roofs and floors. Without being bound to any theory, it is believed that within the instant composite roof or floor system, integration of concrete into the hollow space within the panels of the roof or floor panel assembly creates a shearing action in the concrete, and the plurality of deformation resistance elements disposed on the upper flanges of the studs also assert shearing actions in the concrete. The combination of these structural features provides a synergetic effect, which results in a superior resistance of the instant composite roof or floor system to deformation, particularly deflection in the vertical direction. Moreover, it has been found that in the presence of plurality of deformation resistance elements the distance D between the upper surface of the insulation board and the upper flanges of the studs can be reduced. In the situation when the load is not extensive, the distance D may not be required.

Because of the improvement in the resistance to deflection, the amount of reinforcing materials such as reinforcing bars can be reduced in the instant composite system. On the other hand, it is known that in the traditional composite system an increase in the thickness of the reinforced concrete enhances its resistance to deflection. However, the load associated with thicker concrete is counter-productive, as the increased load adds to the cause of deflection. In the present system, such conflict in technical solutions is resolved. It has been found because of the improvement in resistance to deformation, the present composite roof or floor system does not need to rely on a thicker concrete to maintain structural integrity. As such, in the present composite roof or floor system, the amount of concrete used can be substantially reduced, while maintaining the system in full compliance with construction code requirement in deflection.

Figure 23:
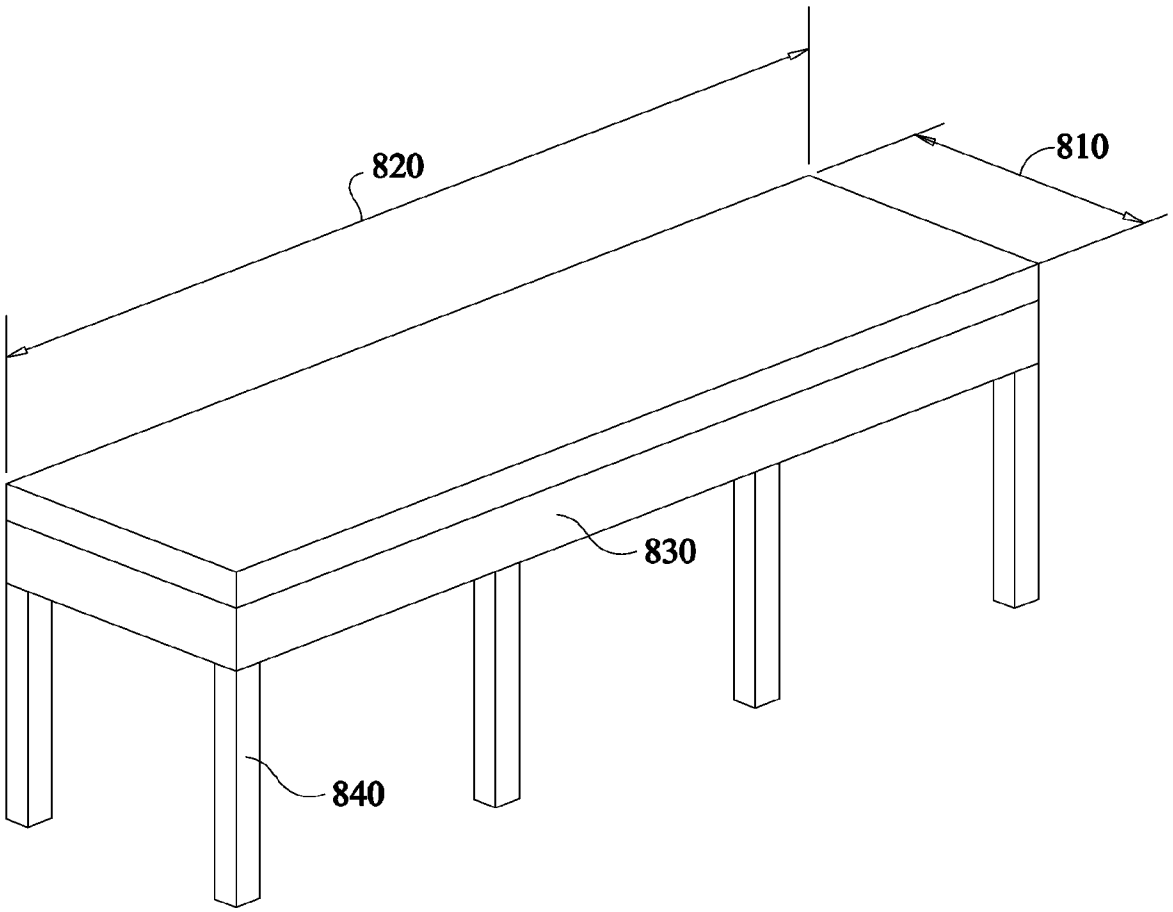
FIG. 23 illustrates a model floor configuration used in an assessment of the present composite floor system in comparison to a conventional system.

The improvement of resistance of the present composite roof or floor system to deformation is demonstrated by a comparative assessment between an existing reinforced concrete floor and the present composite floor system described above. FIG. 23 illustrates the configuration of the floor model used in the assessment. As shown, the floor model has a span 810 of 15 feet and a length 820 of 60 feet. The composite floor is constructed over reinforced beams 830 and eight weight bearing columns 840 distributed around the periphery of the floor. According to American Concrete Institution (ACI) code, for a floor of such a dimension the maximum allowable deflection in the vertical direction is 0.75 inch.

In the traditional system, a 4 inch conventional reinforced cast in place concrete slab over the reinforced beams and columns is constructed. For the present system, floor panels 10 of the present invention having a length of 15 feet and a width of 24 inches, constructed with Gage 20 studs of 8 inch width of the web section, are used. In the present system, a 4 inch reinforced concrete slab integrating the instant floor panels over the reinforced beams and columns is constructed. With both systems, in addition to the dead load of the system, an extra distributed dead load of 60 lb/ft$^2$ and distributed live load of 40 lb/ft$^2$ are added. The long term cracked deflection at the midspan is calculated, and it is 0.504 inch with the conventional system and 0.394 inch with the present system. This clearly shows the improvement achieved by the present system in resistance to deflection in the vertical direction.

It is noted that with the conventional system, a 6 inch thick conventional reinforced cast in place concrete slab can achieve a result in the long term cracked deflection at the midspan comparable to a 4 inch thick composite system of the present invention. However, with the present system, about 30% reinforcing bars and about 30% of concrete can be saved. This represents a significant saving in materials and construction cost. Furthermore, because of the enhanced resistance to deformation, using the roof or floor panels of the present invention, the span of a roof or floor structure can be increased while maintaining the composite roof or floor system in compliance with construction code requirement in deflection.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

What is claimed is:

1. A panel for construction of a composite insulated concrete roof or floor comprising:

(a) two elongated studs, each comprising a planar web section and an upper flange and an lower flange integrally extending from said web section, said two elongated studs aligned in parallel in a longitudinal direction of said studs, with said flanges facing each other; each of said elongated studs having multiple through-holes on said planar web section, spaced apart along said stud in the longitudinal direction;

(b) a plurality of deformation resistant elements protruding from said upper flange of each of said studs, said deformation resistant elements spaced apart along said upper flange of each of said studs in said longitudinal direction; and (c) an insulation board secured between said two elongated studs, said insulation board having upper and lower surfaces, two side edges and a thickness less than a width of said web section of said stud, each of said side edges of the insulation board being against an internal surface of the web section of the studs and covering said multiple through-holes on the web section of the studs, and said lower surface of said insulation board being disposed against said lower flanges of said studs, thereby establishing a distance between said upper surface of said insulation board and said upper flanges of said studs and forming a hollow space therebetween for filling concrete therein.

2. The panel of claim 1, wherein said deformation resistant elements are in a form of brackets or pins.

3. The panel of claim 2, wherein said brackets include a cross sectional shape of rectangular, square, semicircular, triangular, or reversed L-shape.

4. The panel of claim 2, wherein said brackets or pins are an integral part of said upper flanges of said studs, or affixed to said upper flanges of said studs.

5. The panel of claim 2, wherein a distance between two adjacent deformation resistant elements is from about 4 inches to about 12 inches.

6. The panel of claim 2, wherein said brackets or pins have a height from about 0.5 inch to about 2 inches.

7. The panel of claim 2, wherein said brackets or pins have a length, in said longitudinal direction of said stud, from about 0.5 inch to about 4 inches.

8. The panel of claim 2, wherein said brackets or pins have a width from about 0.5 inch to about 3 inches.

9. The panel of claim 1, wherein said multiple through-holes between said two elongated studs are in alignment.

10. The panel of claim 1, wherein said distance between said upper surface of said insulation board and said upper flange of said stud is from about ⅛ to about ⅓ of said width of said web section of said stud.

11. A composite insulated concrete system for roof or floor, comprising:

(a) a panel assembly for roof or floor, comprising a plurality of panels, each thereof comprising: two elongated studs, each comprising a planar web section and an upper flange and an lower flange integrally extending from said web section, said two elongated studs aligned in parallel in a longitudinal direction of said studs, with said flanges facing each other; each of said elongated studs having multiple through-holes on said planar web section, spaced apart along said stud in the longitudinal direction; a plurality of deformation resistant elements protruding from said upper flange of each of said studs, said deformation resistant elements spaced apart along said upper flange of each of said studs in said longitudinal direction; and an insulation board secured between said two elongated studs, said insulation board having upper and lower surfaces, two side edges and a thickness less than a width of said web section of said stud, each of said side edges of the insulation board being against an internal surface of the web section of the studs and covering said multiple through-holes on the web section of the studs, and said lower surface of said insulation board being disposed against said lower flanges of said studs, thereby establishing a distance between said upper surface of said insulation board and said upper flanges of said studs;

said plurality of panels being aligned one next to another, with said web sections of two adjacent elongated studs against each other, with said deformation resistant elements oriented in upward direction;

(b) a plurality of reinforcing bars placed above said panel assembly; and (c) concrete covering said plurality of deformation resistant elements protruding from said upper flange of each of said studs and said plurality of reinforcing bars, said concrete having an integral internal portion thereof filled into a space between said upper surface of said insulation board and said upper flanges of said studs of each of said panels, and a continuous external portion throughout said assembly.

12. The system of claim 11, wherein said deformation resistant elements are in a form of brackets or pins.

13. The system of claim 11, wherein said multiple through-holes among said plurality of panels are in alignment.

14. The system of claim 13, where said multiple through-holes on said studs are blocked by insulation board, and not in contact with said concrete.

15. The system of claim 11, where said system has enhanced resistance to deflection in the vertical direction.

16. A monolithic composite insulated concrete system for wall and roof or floor, comprising:

(a) a wall assembly comprising a plurality of insulation wall panels, each thereof comprising: two elongated wall panel studs aligned, each comprising a planar web section, and an inner flange and an outer flange integrally extending from said web section; and a wall panel insulation board secured between said two wall panel studs, said wall panel insulation board having inner and outer surfaces and a thickness less than a width of said web section of said wall panel stud; said inner surface of said insulation board disposed against said inner flanges of said wall panel studs, thereby establishing a distance between said outer surface of said wall panel insulation board and said outer flanges of said wall panel studs; said wall panel insulation board recessing from upper ends of said wall panel studs;

said plurality of insulation wall panels being aligned one next to another, having said inner surface of said wall panel insulation board facing an interior of a building structure and having said web sections of said elongated wall panel studs against each other;

(b) a panel assembly for roof or floor, comprising a plurality of panels for roof or floor, each thereof comprising: two elongated studs of the panels for roof or floor, each comprising a planar web section, and an upper flange and an lower flange integrally extending from said web section, said two studs aligned in parallel in a longitudinal direction thereof, with said flanges facing each other; each of the studs of the panels for roof or floor having multiple through-holes on said planar web section, spaced apart along said stud in the longitudinal direction; a plurality of deformation resistant elements protruding from said upper flange of each of said studs, said deformation resistant elements spaced apart along said upper flange of each of said studs in said longitudinal direction; and an insulation board secured between said two studs of the panels for roof or floor, said insulation board having upper and lower surfaces, two side edges and a thickness less than a width of said web section of said stud, each of said side edges of the insulation board being against an internal surface of the web section of the studs of the panels for roof or floor and covering said multiple through-holes on the web section of the studs of the panels for roof or floor, and said lower surface of said insulation board being disposed against said lower flanges of said studs, thereby establishing a distance between said upper surface of said insulation board and said upper flanges of said studs of the panels for roof or floor;

said plurality of panels for roof or floor being aligned one next to another, with said deformation resistant elements oriented in upward direction, and with both ends of each of said panels for roof or floor disposed on top of and fastened to said wall panel assembly;

(c) concrete covering throughout said panel assembly for roof or floor, said concrete filled into a space between said upper surface of said insulation board and said upper flanges of said studs of each of said panels for roof or floor, into a space between said outer surface of said wall panel insulation board and said outer flanges of said wall panel studs of each of said wall panels, and into spaces at connections between said panels for roof or floor and said upper ends of said wall panels, thereby forming a continuous concrete body from said panel assembly for roof or floor to said wall assembly and joining said two assemblies into one said monolithic composite insulated concrete system.

17. The system of claim 16, wherein said deformation resistant elements are in a form of brackets or pins.

18. A method of construction of a composite insulated concrete system for roof or floor, comprising:

(a) placing a plurality of panels on supporting structures, each of said panels comprising: two elongated studs, each comprising a planar web section and an upper flange and an lower flange integrally extending from said web section, said two elongated studs aligned in parallel in a longitudinal direction of said studs, with said flanges facing each other; each of said elongated studs having multiple through-holes on said planar web section, spaced apart along said stud in the longitudinal direction; a plurality of deformation resistant elements protruding from said upper flange of each of said studs, said deformation resistant elements spaced apart along said upper flange of each of said studs in said longitudinal direction; and an insulation board secured between said two elongated studs, said insulation board having upper and lower surfaces, two side edges and a thickness less than a width of said web section of said stud, each of said side edges of the insulation board being against an internal surface of the web section of the studs and covering said multiple through-holes on the web section of the studs, and said lower surface of said insulation board being disposed against said lower flanges of said studs, thereby establishing a distance between said upper surface of said insulation board and said upper flanges of said studs; wherein two opposing ends of each of said panels are placed on top of and fastened to said supporting structures;

(b) providing reinforcing bars on top of said plurality of panels; and (c) adding a sufficient amount of concrete on top of said plurality of panels, having said concrete filling into a space between said upper surface of said insulation board and said upper flanges of said studs of each of said panels, covering said deformation resistant elements on said upper flanges of said studs and said reinforcing bars, and allowing said concrete to cure, thereby forming a composite insulated concrete system for roof or floor.

19. The method of claim 18, wherein said deformation resistant elements are in a form of brackets or pins.

* * * * *